United States Patent [19]

Hoffmeister et al.

[11] Patent Number: 4,993,750

[45] Date of Patent: Feb. 19, 1991

[54] PAGE HOLDER FOR PHOTO ALBUM

[75] Inventors: Thomas Hoffmeister, Sunapee, N.H.; Sheldon Holson, Norwalk, Conn.

[73] Assignee: The Holson Company, Forestdale, R.I.

[21] Appl. No.: 507,377

[22] Filed: Apr. 10, 1990

[51] Int. Cl.[5] ..... B42D 17/00

[52] U.S. Cl. ..... 281/48; 281/46; 40/536; 248/447

[58] Field of Search ..... 281/46, 48, 49, 50, 281/47, 45; 40/530-536; 211/94, 162; 248/442.2, 447

[56] References Cited

U.S. PATENT DOCUMENTS

| | | | |
|---|---|---|---|
| 1,051,453 | 1/1913 | Roedde | 281/48 |
| 1,279,673 | 9/1918 | Dobersch . | |
| 1,399,016 | 12/1921 | Jones . | |
| 1,408,817 | 3/1922 | MacDonald . | |
| 1,469,573 | 10/1923 | Aberle . | |
| 1,624,660 | 4/1927 | Feldmann . | |
| 3,051,181 | 8/1962 | Johnson | 281/48 |
| 3,469,333 | 9/1969 | Roberts . | |
| 3,950,012 | 4/1976 | Donovan | 40/536 |
| 3,971,572 | 7/1976 | Fenkel | 281/46 |
| 4,426,007 | 1/1984 | Beleckis et al. | 281/46 |
| 4,561,623 | 12/1985 | Shepherd et al. | 248/447 |
| 4,591,187 | 5/1986 | Jeanson et al. | 281/46 |
| 4,867,479 | 9/1989 | Mizutani | 281/48 |

FOREIGN PATENT DOCUMENTS 1464012 11/1966 France .

*Primary Examiner*—Paul A. Bell
*Assistant Examiner*—Hwei-Siu Payer
*Attorney, Agent, or Firm*—St. Onge Steward Johnston & Reens

[57] ABSTRACT

A page holder for a photo album is described wherein photo pages can be conveniently entered or removed from a photo album. Hinge retainers are placed on lower and upper ends of the spine of the photo album. In the preferred embodiment, each hinge retainer is formed of a pair of spaced-apart pier segments, an end wall and an overlying bridge segment so as to form a holding space in which the hinge ends of a photo page are retained. The bridge segments have slots that are aligned and oriented generally along the spine so as to freely pass the hinge ends. A closure element laterally slides along the bridge segments so as to cover or open the slots. Several embodiments are described.

10 Claims, 3 Drawing Sheets

FIG. 1
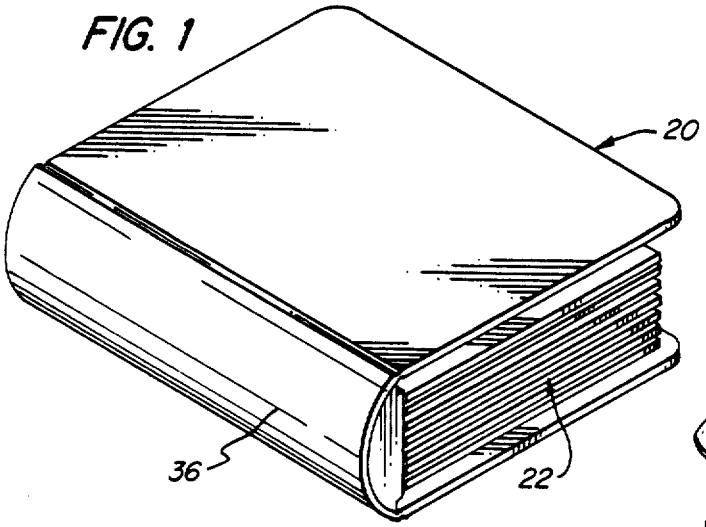
FIG. 6
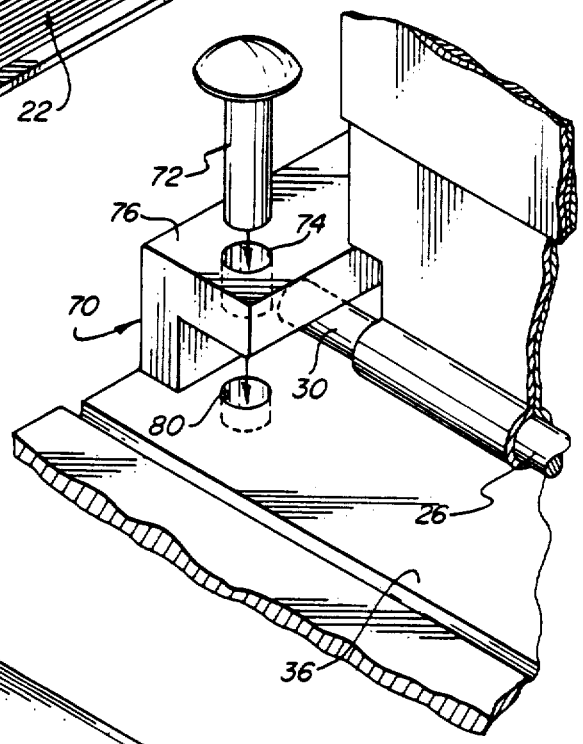
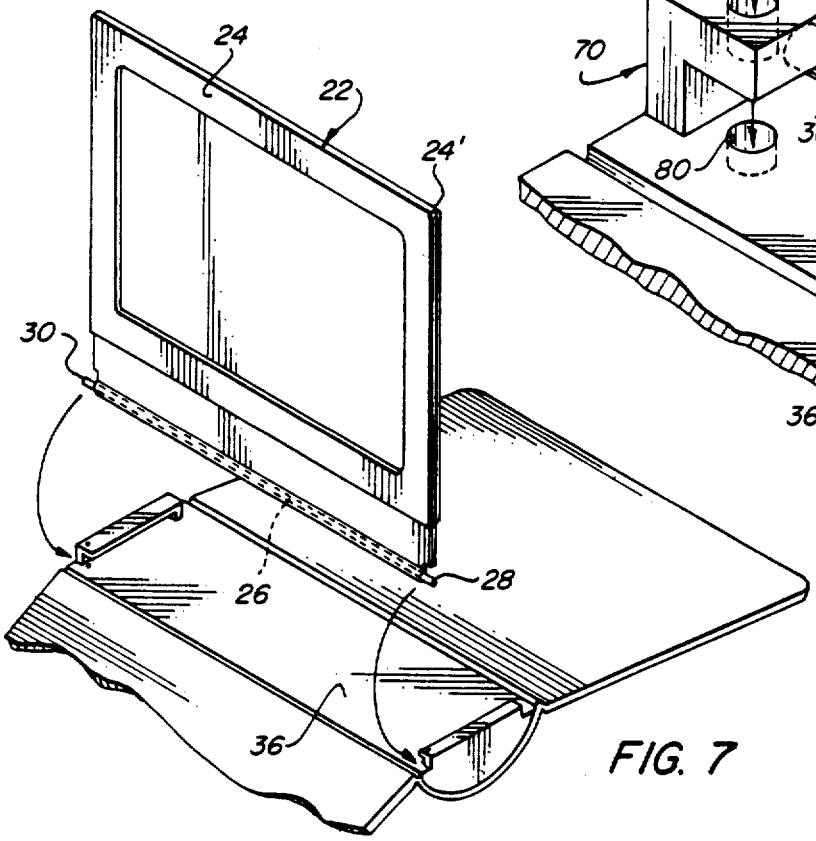
FIG. 7

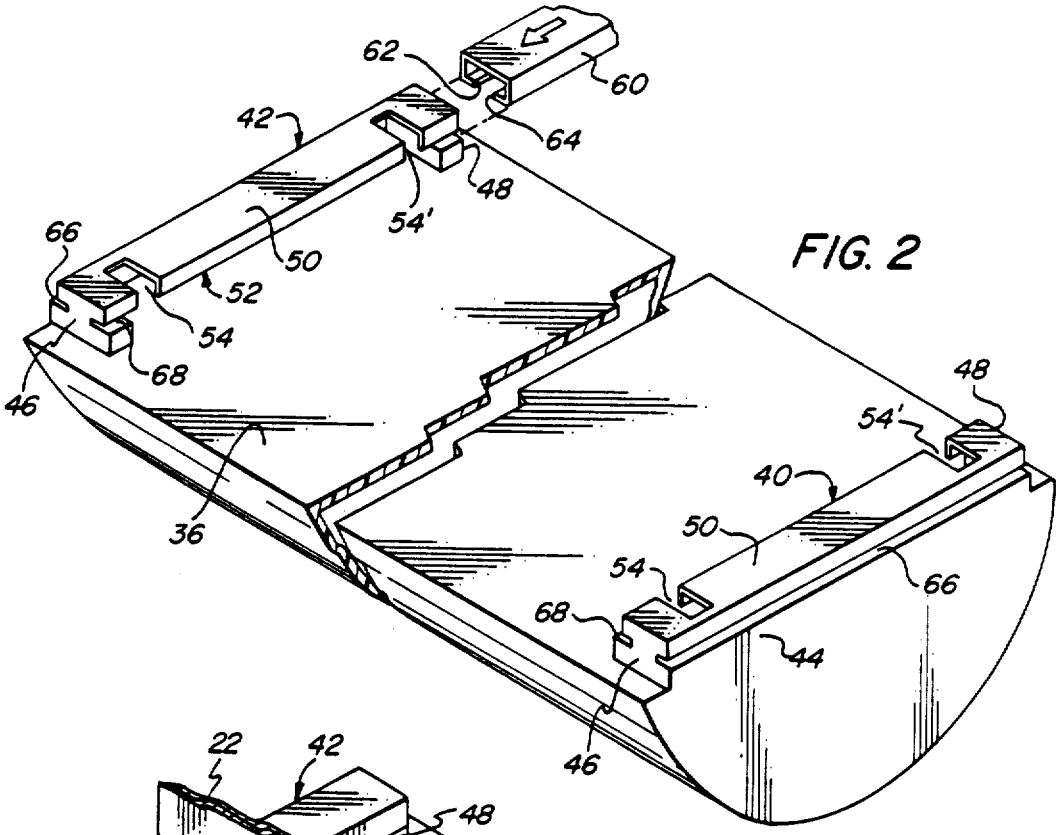
FIG. 2
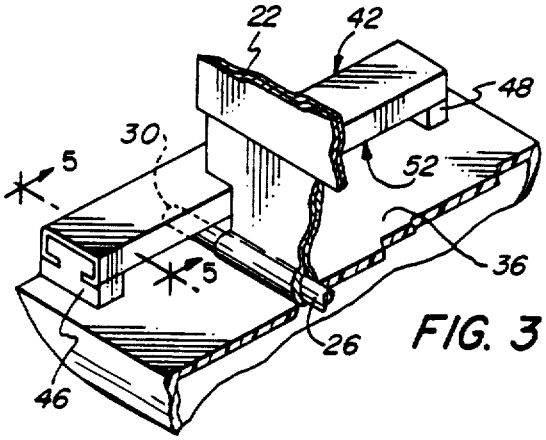
FIG. 3
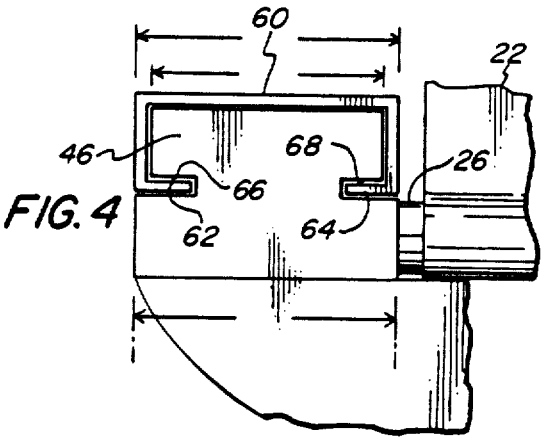
FIG. 4
FIG. 5
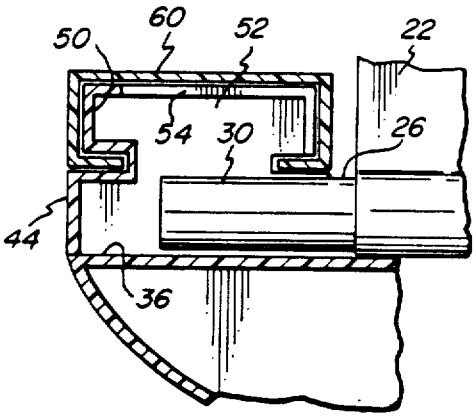

FIG. 8
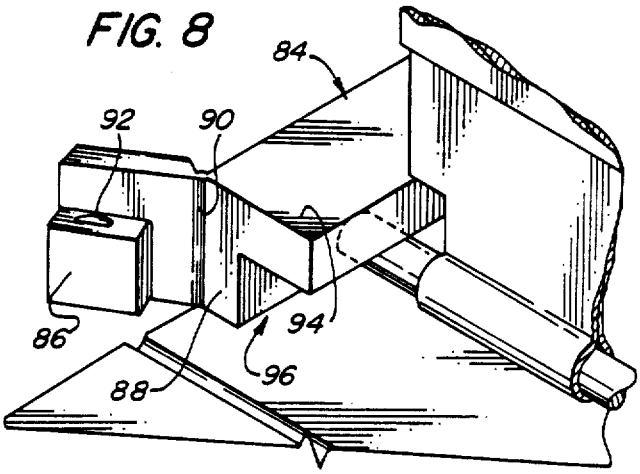
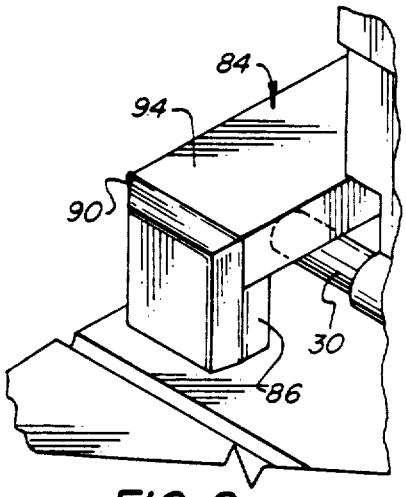
FIG. 9
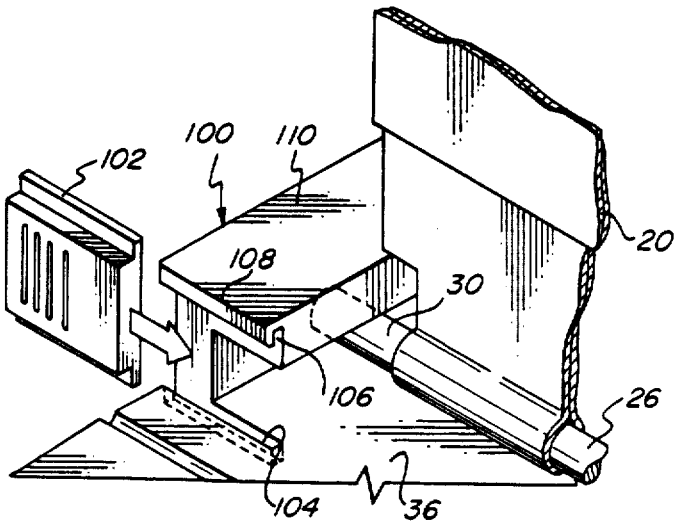
FIG. 10
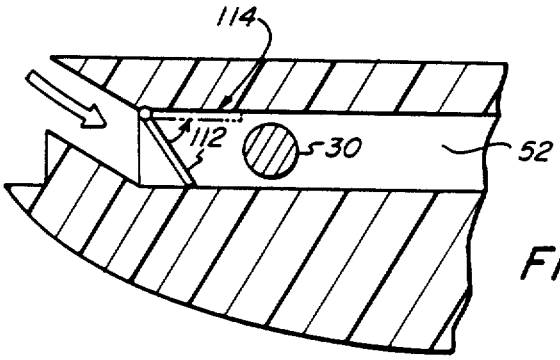
FIG. 11

PAGE HOLDER FOR PHOTO ALBUM

FIELD OF THE INVENTION

This invention generally relates to photo albums and more specifically to a photo album page holder with which photo frame pages can be inserted and retained in a photo album.

BACKGROUND OF THE INVENTION

Photo albums are well known for storing photo frame pages that can be replaced and inserted as desired. U.S. Pat. No. 3,469,333 is one example of such album. This shows a photo frame page with a wire rod hinge. The page has a frame to hold a photo and is inserted in slots formed by hinge retainers located on the album spine. Insertion is obtained by bending the wire rod.

In well known professional-type photo albums, their spines are provided with a pair of hinge retainers formed of end walls, pier segments and bridge portions overlying them to form holding spaces in which the hinge ends of photo pages are inserted by bending of the hinge.

In the U.S. Pat. No. 1,399,016 to Jones, a loose leaf binder is shown. The leaves have metal hinge rods that are held by pivotable plates. The plates are located at the end of the spine of the binder and have slots for holding the hinge rods of the loose leaves. Insertion or removal of a leaf requires unscrewing of plate holding screws and pivoting of the plates so as to expose enlarged slot portions through which the page rods are mounted. After such page insertion, the plates are pivoted back to their locking position and the locking screws re-applied.

U.S. Pat. No. 1,279,673 to Dobersch shows a loose-leaf binder in which the spine, at its ends, has rectangular blocks with grooves into which the wire rods of loose leaf pages are inserted from a lateral side of the spine. Pivoted hasps are mounted to the lateral side of the spine to close or open the entrance to the grooves.

French Pat. No. 1,464,012 illustrates a loose-leaf binder formed with retaining blocks that have grooves which terminate at a side of the block. Removable clips that fit into the hollow block are used to close the groove and prevent escape of page hinges.

Other loose leaf binders are shown in U.S. Pat. Nos., 1,624,660 to Feldmann, 1,469,573 to Aberle and 1,408,817 to MacDonald.

SUMMARY OF THE INVENTION

With a photo album page holder in accordance with the invention, a deformation of photo frame pages to insert them into a photo album is avoided. Photo frame pages can be conveniently inserted or replaced while preserving a neat professional appearance.

This is achieved in accordance with one embodiment of the invention with hinge retainers that are small and unobtrusively placed on the inner surface of the spine of a photo album. The hinge retainers are formed of end walls which extend laterally across the spine and whose outer surfaces are aligned respectively with the upper and lower end surfaces of the spine. Bridge segments extend coextensively with and over the end walls and have widths wider than the end wall. Pier segments are located near lateral sides of the spine and adjacent the end walls to form holding spaces for page hinge ends. The bridge segments have slots that extend longitudinally parallel with the length of the spine and are sized to freely pass exposed hinge ends of an album page for its insertion or removal. Movable closure elements are mounted to and over the bridge segments and can be laterally slid so as to cover or expose the slots.

Insertion or removal of an album page can thus be conveniently carried out by sliding upper and lower closure elements laterally to the side to expose slots. A photo page can then be conveniently mounted to a hinge retainer by passing its hinge ends through exposed slots into the holding spaces and then laterally sliding the closure element to cover the slots.

It is, therefore, an object of the invention to provide improved hinge retainers for photo albums into which photo pages can be conveniently inserted or removed without deformation of their wire hinges.

These and other advantages and objects of the invention can be understood from the following detailed description of various embodiments described in conjunction with the drawings.

BRIEF DESCRIPTION OF DRAWINGS

FIG. 1 is a perspective view of a typical photo album;

FIG. 2 is a perspective view of the spine of a photo album with hinge retainers in accordance with the invention;

FIG. 3 is a perspective in partial section and broken away view of a photo album hinge retainer shown in FIG. 2;

FIG. 4 is a lateral end view of the photo album hinge retainer shown in FIG. 3;

FIG. 5 is a section view of the photo album hinge retainer taken along the lines 5—5 in FIG. 3;

FIG. 6 is an enlarged perspective partial section view of an alternate closure element for a photo album hinge retainer in accordance with the invention;

FIG. 7 is a partial perspective view of a photo album, its hinge retainers and a photo page to be held thereby;

FIGS. 8 and 9 are enlarged perspective views of an alternate photo album hinge retainer in accordance with the invention;

FIG. 10 is an enlarged perspective view of an alternate photo album hinge retainer in accordance with the invention; and FIG. 11 is an enlarged section view of still another photo album hinge retainer in accordance with the invention.

DETAILED DESCRIPTION OF DRAWINGS

With reference to FIGS. 1 and 7, a photo album 20 is shown that is commonly referred to in the trade as a professional photo album. Such album is typically used to store photos in separate individually-insertable and removable pages 22 for photos of special occasions, such as weddings.

The photo pages 22 usually provide double sided frames 24, 24' that extend from a common hinge in the form of a wire rod 26. The ends 28, 30 of the rod 26 are exposed to fit into hinge retainers mounted on the spine 36 of the photo album 20.

With further reference to FIGS. 2-5, the spine 36 is shown provided with lower and upper-located hinge retainers 40, 42. Each hinge retainer is formed with an end wall 44, a pair of laterally-located pier segments 46, 48 and a bridge portion 50 that lies over the pier segments 46, 48 and endwall 44 and extends inwardly so as to form a holding space 52.

The bridge portions 50 have slots 54, 54' aligned with the longitudinal direction of the spine 36 and with opposing slots in registration with each other to enable the removal or insertion of a page while it is aligned as shown in FIG. 7. The holding spaces 52 are sized to freely receive, through slots 54, 54', the hinge ends 28, 30 of a photo frame page 22.

Each hinge retainer is provided with a movable closure element 60 that slides over the bridge portions 50 to either cover or uncover slots 54, 54'. Closure elements 60 are channel-shaped with spaced-apart inwardly-facing edges 62, 64 that are spaced, shaped, and sized to slide in respective grooves 66, 68. Groove 66 faces out and extends laterally across and between pier segments 46 and 48. Groove 68 faces inwardly and extends across pier segments 46 and 48.

The bridge portion 50 is recessed from the end wall 44 by an amount selected to provide an essentially flush appearance both above and below the spine when the closure element 60 is applied. This flush fit can be seen in the views of FIGS. 4 and 5. Insertion or removal of a photo frame page 22 is conveniently carried out by simply sliding the closure elements 60 laterally across to open appropriate slots 54, 54' and back again after the page handling is completed.

In the embodiment shown in FIG. 6, hinge retainers such as 70 are used. This includes a removal of one pier segment 46 or 48 to form openings for the removal or insertion of hinge ends 28, 30. The closure element is in the form of a pin 72 that removably slides through a hole 74 in a bridge portion 76, through holding spaces 52 into a hole 80 in spine 36.

In FIGS. 8 and 9 a hinge retainer 84 is shown wherein one pier segment 86 is movable. The pier segment 86 is connected to end wall 88 with a live hinge 90. Pier segment 86 has a projection 92 that frictionally engages the underside of bridge portion 94 to cap the lateral side opening 96 in the manner as shown in FIG. 9.

In FIG. 10 a photo album hinge retainer 100 is shown. The pier segment 102 is slidably movable in slots 104, 106 formed respectively in the spine 36 and a lateral extension 108 of bridge segment 110.

In FIG. 11 a flapper closure element 112 is pivotally located within the holding space 52. The element 112 is normally spring loaded in a closed position to prevent escape of the hinge end 30. When desired, however, the closure element can be pivoted up as shown at 114 to enable removal of a hinge end.

Having thus explained various embodiments of the invention, its advantages to facilitate the entry and removal of photo album pages can be appreciated. Variations can be made from the embodiments without departing from the scope of the invention.

What is claimed is:

1. A photo album page holder for use on the inner surface of the spine of a photo album to hold removable photo frame pages having wire rods that serve as page hinges with rod ends for mounting to the spine, comprising:

elongate hinge retainers mounted at upper and lower ends of the spine;

said hinge retainers having end walls extending laterally across the spine and pier segments located at lateral ends of the end walls and further having bridge segments that are affixed to upper ends of the end walls and the pier segments and extend coextensively therewith across the spine; the width of the bridge segments being selected so that the bridge segments extend inwardly from the end walls towards each other so as to form holding spaces bounded by the bridge segments, the inner surface of the spine and the end walls; said spaces being sized to freely receive and retain rod ends of photo frame pages without bending thereof; with at least one of said retainers being provided with an opening that extends parallel with the length of the spine for a distance that is sufficient to move a wire rod into and out of the holding spaces substantially without bending thereof; and a movable closure element mounted for lateral slidable motion to the bridge segment having the opening so that in one lateral position the element covers the opening to inhibit escape of a photo frame page wire rod from the holding spaces while in another lateral position of the element it uncovers the opening to enable insertion of a said photo frame page wire rod.

2. The photo album page holder as claimed in claim 1 wherein both of said retainers have pier segments located at lateral ends of the holding spaces beneath the bridge segments, said pier segments providing lateral side walls to the holding spaces and wherein said opening is formed in each said bridge segment in the vicinity of lateral ends of the holding spaces.

3. The photo album page holder as claimed in claim 2 wherein each bridge segment in a retainer has a pair of openings in the form of slots at lateral ends of the holding space over which the bridge segment extends.

4. The photo album page holder as claimed in claim 3 wherein the closure elements are sized to substantially coextensively extend along the bridge segments so as to cover the slots therein.

5. The photo album page holder as claimed in claim 4 wherein the slots in one bridge segment are in registration with the slots in the other bridge segment.

6. The photo album page holder as claimed in claim 4 wherein the pier segments and the end wall have laterally-aligned grooves at opposite sides, and wherein the closure elements are channel-shaped with spaced apart inwardly-facing edges shaped and sized to slide within said grooves.

7. A photo album page holder for use on the inner surface of the spine of a photo album to hold removable photo frame pages having wire rods that serve as page hinges with rod ends for mounting to the spine, comprising:

elongate hinge retainers mounted at upper and lower ends of the spine;

said hinge retainers having end walls extending laterally across the spine and having bridge segments that are affixed to upper ends of the end walls and extend coextensively therewith across the spine; the width of the bridge segments being selected so that the bridge segments extend inwardly from the end walls towards each other so as to form holding spaces between the bridge segments and the inner surface of the spine; said spaces being sized to freely receive and retain rod ends of photo frame pages without bending thereof; with at least one of said retainers being provided with an opening that extends parallel with the length of the spine for a distance that is sufficient to slide a wire rod into and out of the holding spaces substantially without bending thereof; and a movable closure element mounted to the retainer having the opening so as to inhibit escape of a photo frame page wire rod from the holding spaces and to enable insertion of said photo frame page wire rod, wherein said closure element comprises a pin that is removably mounted to a bridge segment to slide through the bridge segment through the holding space near said opening and into said spine.

8. A photo album page holder for use on the inner surface of the spine of a photo album to hold removable photo frame pages having wire rods that serve as page hinges with rod ends for mounting to the spine, comprising:

elongate hinge retainers mounted at upper and lower ends of the spine;

said hinge retainers having end walls extending laterally across the spine and having bridge segments that are affixed to upper ends of the end walls and extend coextensively therewith across the spine; the width of the bridge segments being selected so that the bridge segments extend inwardly from the end walls towards each other so as to form holding spaces between the bridge segments and the inner surface of the spine; said spaces being sized to freely receive and retain rod ends of photo frame pages without bending thereof; with the space in at least one of said retainers being laterally accessable so as to form an opening that is bounded by an end wall, the bridge segment and the spine and extends parallel with the length dimension of the spine for a distance that is sufficient to slide a wire rod into and out of the holding spaces substantially without bending thereof; and a movable closure element mounted to the retainer having the opening so as, in a closed position, to inhibit escape of a photo frame page wire rod from the holding spaces and to enable insertion of one of said photo frame page wire rods wherein said closure element has a live hinge which is connected to said end wall, said closure element having a pier portion sized to snugly fit underneath the bridge segment to cap the opening and having a projection that frictionally engages the bridge segment to secure the closed position of the element.

9. A photo album page holder for use on the inner surface of the spine of a photo album to hold removable photo frame pages having wire rods that serve as page hinges with rod ends for mounting to the spine, comprising elongate hinge retainers mounted at upper and lower ends of the spine;

said hinge retainers having end walls extending laterally across the spine and having bridge segments that are affixed to upper ends of the end walls and extend coextensively therewith across the spine; the width of the bridge segments being selected so that the bridge segments extend inwardly from the end walls towards each other so as to form holding spaces between the bridge segments and the inner surface of the spine; said spaces being sized to freely receive and retain rod ends of photo frame pages without bending thereof; with at least one of said retainers being provided with an opening that extends parallel with the length of the spine for a distance that is sufficient to slide a wire rod into and out of the holding spaces substantially without bending thereof; and a movable closure element mounted to the retainer having the opening so as to inhibit escape of a photo frame page wire rod from the holding spaces and to enable insertion of one of said photo frame page wire rods, wherein said closure element comprises a movable flapper element mounted in the holding space near the opening and oriented so as to facilitate entry of a rod end through the opening and normally obstruct escape of said rod end.

10. A photo album page holder for use on the inner surface of the spine of a photo album to hold removable ,/ pages having hinges for mounting to the photo album, comprising:

elongate hinge retainers placed at upper and lower ends of the spine of an album, each retainer having pier segments mounted on the spine near lateral sides thereof, and a bridge portion whose ends are supported by the piers so as to form a space between the bridge portion and the spine to receive and retain the ends of page hinges;

each said bridge portions having a slot extending generally parallel to the length of the spine and located and aligned to receive the end of a page's hinge end substantially without bending of the hinge, the bridge portions having upper surfaces that are generally parallel to the surface of the spine, and wherein the pier segments have grooves aligned parallel to the upper surfaces of the bridge portions mounted thereto, and moveable closures slidably mounted to the bridge portions for closing the openings therein to prevent escape of the hinge end through the openings; said movable closures having edges sized to slidingly fit inside the grooves to enable the closures to slidingly move over the openings while in retaining relationship with the bridge portions.

* * * * *